US009788102B2

(12) United States Patent
Sano

(10) Patent No.: US 9,788,102 B2
(45) Date of Patent: Oct. 10, 2017

(54) UNIDIRECTIONAL MICROPHONE UNIT

(71) Applicant: KABUSHIKI KAISHA AUDIO-TECHNICA, Machida-shi, Tokyo (JP)

(72) Inventor: Yusuke Sano, Machida (JP)

(73) Assignee: KABUSHIKI KAISHA AUDIO-TECHNICA, Machida-Shi, Tokyo (JP)

( * ) Notice: Subject to any disclaimer, the term of this patent is extended or adjusted under 35 U.S.C. 154(b) by 0 days.

(21) Appl. No.: 15/285,045

(22) Filed: Oct. 4, 2016

(65) Prior Publication Data

US 2017/0099540 A1 Apr. 6, 2017

(30) Foreign Application Priority Data

Oct. 5, 2015 (JP) ..... 2015-197662

(51) Int. Cl.
*H04R 9/08* (2006.01)
*H04R 1/22* (2006.01)
*H04R 1/08* (2006.01)

(52) U.S. Cl.
CPC ..... *H04R 1/222* (2013.01); *H04R 1/083* (2013.01)

(58) Field of Classification Search
CPC combination set(s) only.
See application file for complete search history.

(56) References Cited

U.S. PATENT DOCUMENTS

2005/0190944 A1* 9/2005 Akino ..... H04R 1/38 381/369

FOREIGN PATENT DOCUMENTS

JP 2013-223057 A 10/2013

* cited by examiner

*Primary Examiner* — Amir Etesam
(74) *Attorney, Agent, or Firm* — Manabu Kanesaka

(57) ABSTRACT

In a unidirectional microphone unit, stable frequency characteristics can be obtained, and manufacturing cost is reduced while preventing increasing of an external size. A microphone cap that covers a microphone element is included, and the microphone cap includes a porous ring member arranged in the front of the microphone element to form a first communication space communicating with a front acoustic hole in a center side, and a cylindrical member supporting a peripheral edge portion of the ring member and surrounding a periphery side of the microphone element, and forming a second communication space communicating with a rear acoustic hole in the periphery side of the microphone element, and the first communication space and the second communication space are communicated through the ring member.

2 Claims, 6 Drawing Sheets

UNIDIRECTIONAL MICROPHONE UNIT

RELATED APPLICATIONS

The present application is based on, and claims priority from, Japanese Application No. JP2015-197662 filed Oct. 5, 2015, the disclosure of which is hereby incorporated by reference herein in its entirety.

BACKGROUND OF THE INVENTION

Field of the Invention

The present invention relates to a unidirectional microphone unit, and especially relates to a unidirectional microphone unit that allows to obtain stable frequency characteristics.

Description of the Related Art

Conventionally, a unidirectional microphone has openings (sound holes 51 and 52) in the front and rear area of a microphone unit 50 to collect sound waves, as illustrated in FIG. 6. Accordingly, a front acoustic terminal 61 occurs on the front side of the unit, and a rear acoustic terminal 62 occurs on the rear side of the unit. The acoustic terminal refers to a position of air that effectively provides a sound pressure to the microphone unit 50. In other words, the acoustic terminal is a central position of air simultaneously moving with a diaphragm included in the microphone unit. In a case of the unidirectional microphone unit, the acoustic terminals occur in a front portion and a rear portion of the diaphragm, as described above.

A fixed distance is provided between the front acoustic terminal 61 and the rear acoustic terminal 62, and this fixed distance is called a distance between acoustic terminals. Note that, in FIG. 6, the solid line connecting the acoustic terminals 61 and 62 is a distance between acoustic terminals for high-frequency range, and the broken line is a distance between acoustic terminals for low-frequency range. Conventionally, the distance between acoustic terminals for high-frequency range and the low-frequency range coincide with each other approximately.

The sound waves entering the microphone respectively enter the front acoustic terminal 61 and the rear acoustic terminal 62 with a time difference. The sound waves having entered from the front acoustic terminal and the rear acoustic terminal, respectively, pass through different routes, and overlap with each other at a front side and a rear side of the diaphragm. Through this wave synthesis, only the sound wave arriving from the rear acoustic terminal is cancelled, and unidirectionality is realized.

By the way, the distance between acoustic terminals is determined by a microphone shape, and which sometimes causes to occur acoustical inconvenience. For example, problems may occur such that an output is decreased in a specific frequency due to relationship between the distance of acoustic terminals and a wavelength, and howling is more likely to occur because output levels in a front direction (0° direction) and a backward direction (180° direction) become the same.

Further, dips and peaks occur in frequency response as the sound waves are mutually cancelled or overlap with each other due to the relationship between the distance between acoustic terminals and the wavelength. The occurrence of the dips and peaks becomes a cause failing to maintain the frequency characteristics constant.

To address the problems, in a microphone disclosed in JP 2013-223057 A, the shape of a housing is changed to adjust a distance between acoustic terminals. A unidirectional condenser microphone disclosed in JP 2013-223057 A includes a directivity variable member formed into a hollow tubular shape arranged to contact closely to an outer periphery of a cylindrical microphone case. The directivity variable member is formed of a porous sintered material. Selection of a mode to cover a rear acoustic terminal with the directivity variable member, and a mode to release the rear acoustic terminal and shift a front acoustic terminal to the front of the microphone case enables fine adjustment of directivity.

However, if the directivity variable member is attached around the microphone case, like the microphone disclosed in JP 2013-223057 A, an external size of the microphone becomes large, and the distance between acoustic terminals becomes long. Therefore, there is a problem of a decrease in drive force in a high-frequency range where the wavelengths are short.

To address the problem, conventionally, adjustment of an distance between acoustic terminals and a resonance has been performed with a metal-made housing 70 having notches 71 communicating with rear sound holes 72, as illustrated in FIG. 7A. Alternatively, holes 81 communicating with rear sound holes 82 are formed in a metal housing 80 by drilling, as illustrated in FIG. 7B, and a wavelength to pass is adjusted by setting of a hole diameter. However, these conventional microphones have a problem of high manufacturing cost.

SUMMARY OF THE INVENTION

The present invention has been made in view of the foregoing, and an objective is to provide a unidirectional microphone unit that allows to obtain stable frequency characteristics, and can reduce the manufacturing cost while preventing increasing of an external size.

To solve the problems, the unidirectional microphone unit according to the present invention includes: a microphone element that converts a sound wave received by a diaphragm into an electrical signal, a front acoustic hole, a rear acoustic hole, and a microphone cap that covers the microphone element and includes a porous ring member arranged in the front of the microphone element, and forming a first communication space communicating with the front acoustic hole in a center side, and a cylindrical member supporting a peripheral edge portion of the ring member and surrounding a periphery side of the microphone element, and forming a second communication space communicating with the rear acoustic hole in the periphery side of the microphone element, and the first communication space and the second communication space are communicated through the ring member.

Note that it is desirable to include a mesh member covering the ring member, at a front portion of the ring member.

The porous ring member is provided in a front portion of the microphone unit, as described above, so that routes of the sound waves are divided according to frequencies of the sound waves. The division of the routes enables adjustment of the distance between acoustic terminals corresponding to the frequencies.

Accordingly, for example, by shifting the distance between acoustic terminals for a wavelength of a specific sound wave, occurrence of dips and peaks is suppressed, and stable frequency characteristics can be obtained.

Further, strength of resonance and a resonant frequency can be adjusted by setting of the height, an inner diameter, and a porosity of the ring member, and thus an output level becomes controllable. Therefore, a difference between output levels of a front direction and a back direction is reduced, and thus the configuration of the present invention enables to prevent occurrence of howling.

Further, according to the configuration of the present invention, processing such as cutting and drilling to a housing is not necessary while preventing increasing of the external size. Therefore, the manufacturing cost can be reduced.

Further, the mesh member is provided to cover a front surface side of the ring member. Therefore, windbreak effect is further improved, and occurrence of noises due to wind can be suppressed.

DESCRIPTION OF THE PREFERRED EMBODIMENTS

Hereinafter, an embodiment of the present invention will be described with reference to the accompanying drawings.

Figure 1:
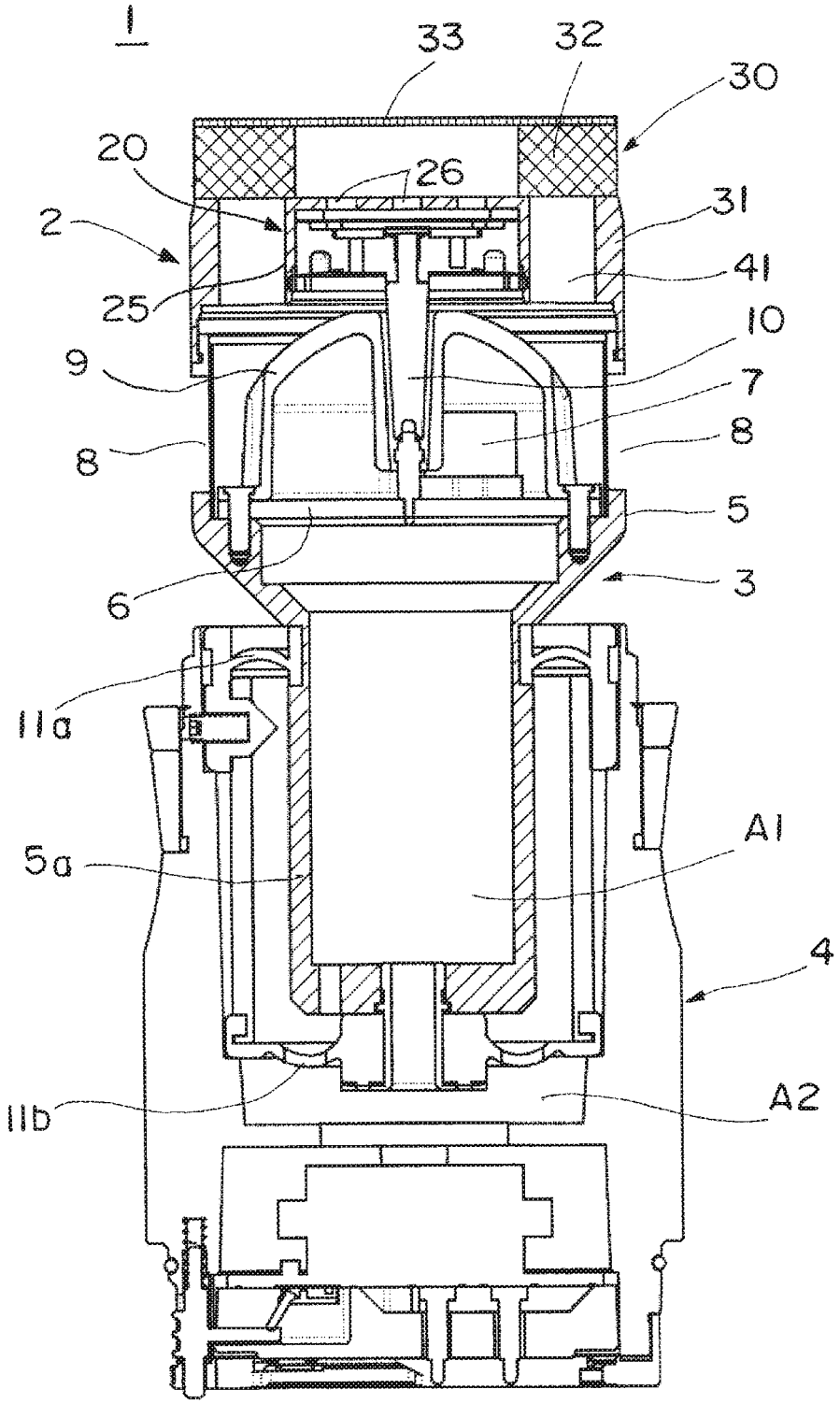
FIG. 1 is a sectional view of a microphone including a unidirectional microphone unit according to the present invention.
Figure 2:
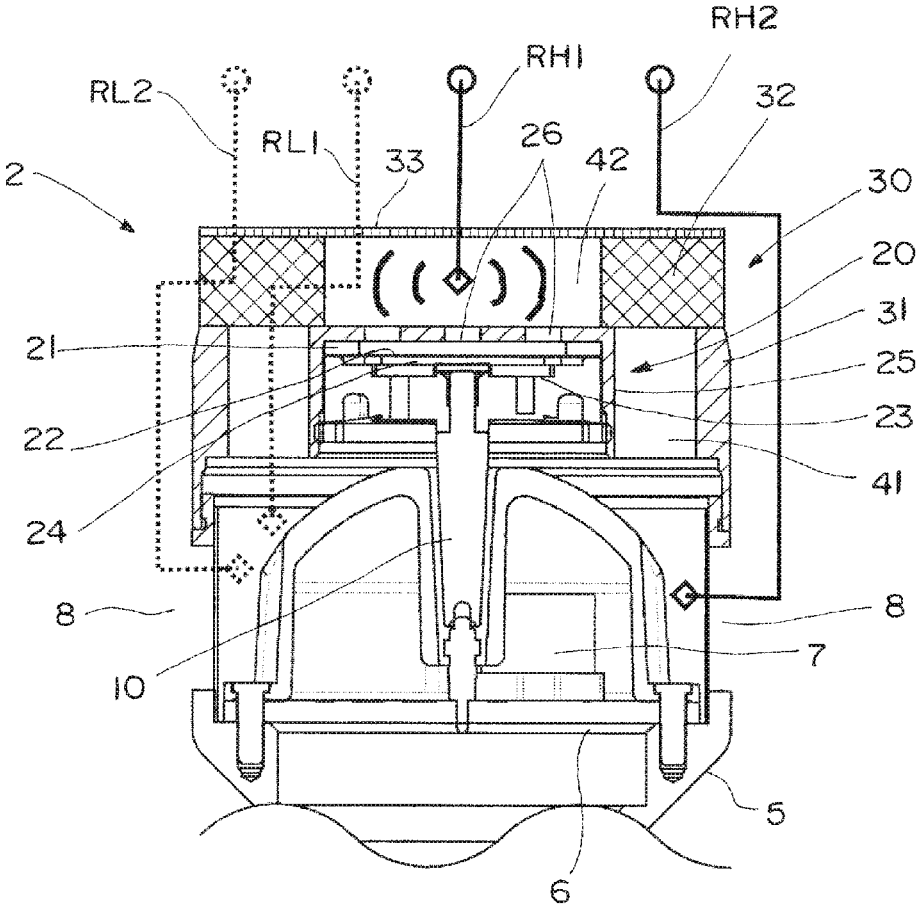
FIG. 2 is an enlarged sectional view of a condenser-type microphone unit included in the microphone of FIG. 1.

FIG. 1 is a sectional view of a microphone including a unidirectional microphone unit according to the present invention. FIG. 2 is an enlarged sectional view of a condenser microphone unit included in the microphone of FIG. 1.

A microphone 1 illustrated in FIG. 1 includes, as a basic configuration, a unidirectional microphone unit 2, a unit support portion 3 that supports the microphone unit 2, and a microphone housing 4, used as a microphone grip, that holds the unit support portion 3 inside.

The unit support portion 3 that supports the microphone unit 2 includes a cylinder 5 made of metal, and a circuit board 6 is arranged in the cylinder 5. On the circuit board 6, an audio signal output unit 7 including a field effect transistor (FET) as an impedance converter and the like is mounted.

Further, the microphone unit 2 is detachably connected to an upper end (front portion side) of the cylinder 5. A rear portion side of the microphone unit 2 communicates with an upper end opening of the cylinder 5, and a rear acoustic hole 8 for taking sound waves as a rear sound source is drilled on a side surface of an upper end of the cylinder 5.

Further, a dome-shaped cover member 9 that acoustically seals an upper surface side of the circuit board 6 is provided in the cylinder 5, for volume adjustment of a back space of the microphone unit.

An electrode rod 10 is provided to penetrate a center of the cover member 9. The electrode rod 10 electrically connects a microphone element 20, which is included in the microphone unit 2 and described later, to the circuit board 6 when the microphone unit 2 is connected to the cylinder 5.

Further, the cylinder 5 integrally includes, in a lower portion (a lower-side portion with respect to the circuit board 6), a cylindrical base portion 5*a* with a small diameter to be inserted into the microphone housing 4, and is elastically held by the microphone housing 4 through vibration isolation means at the cylindrical base portion 5*a*.

In FIG. 1, the vibration isolation means includes a first cushioning member 11*a* that supports an upper end of the cylindrical base portion 5*a* and a second cushioning member 11*b* that supports a lower end side of the cylindrical base portion 5*a*. Both of the first cushioning member 11*a* and the second cushioning member 11*b* are made of a ring body having rubber elasticity.

In the present invention, the microphone unit 2 has a feature in the configuration, and hereinafter, the configuration will be described in detail with reference to FIG. 2.

The microphone unit 2 includes the microphone element 20 that converts a sound wave received by a diaphragm into an electrical signal. The microphone element 20 includes a unit casing 25. In the unit casing 25, a diaphragm 22 stretched over a diaphragm support ring 21 in a state and a fixed electrode plate 24 supported by an insulating base 23 are arranged to dispose to each other across a spacer ring (not illustrated). The diaphragm 22 is stretched over the diaphragm support ring 21 in a state of being applied with predetermined tension. A plurality of front acoustic holes 26 is formed in a front surface of the unit casing 25.

A synthetic resin thin film including a metal-deposited film on one surface is used for the diaphragm 22. The diaphragm 22 is stuck to the diaphragm support ring 21, by using an adhesive on the metal-deposited film side of the diaphragm.

Further, as illustrated in FIGS. 1 and 2, the microphone unit 2 includes a microphone cap 30 connected to the upper end of the cylinder 5 to cover the entire microphone element 20 (unit casing 25). The microphone cap 30 includes a cylindrical member 31 that covers a periphery side of the unit casing 25, a ring member 32 having a peripheral edge portion supported by an upper end of the cylindrical member 31, and a mesh member 33 made of metal provided to cover a front surface side of the ring member 32. The ring member 32 is made of a sintered porous body made of a foamed material or a resin material, for example, and functions as an acoustic resistance material that allows low-frequency range sound waves to pass through.

A communication space 41 (a second communication space) communicating with the rear acoustic hole 8 and serving as a passage of sound is formed on a periphery side of the microphone element 20, that is, between an inner peripheral surface of the cylindrical member 31 and an outer peripheral surface of the unit casing 25.

Further, a communication space 42 (a first communication space) is formed in a center of the ring member 32. The plurality of front acoustic holes 26 formed in the front surface of the unit casing 25 is arranged on a bottom portion of the communication space 42.

The communication space 41 and the communication space 42 are separated by the ring member 32.

Here, the ring member 32 functions as an acoustic resistance material that the low-frequency range sound waves can easily pass through. Therefore, the low-frequency range sound waves are collected through the front acoustic holes 26 and passes through the ring member 32 in the microphone unit 2. In other words, the low-frequency range sound waves pass through a route RL1 passing through the communication space 42 in the center of the ring member 32, the ring member 32, and the communication space 41 inside of the cylindrical member 31, a route RL2 passing through the ring member 32, an outside of the cylindrical member 31, and the rear acoustic hole 8, and the like, and are transmitted to the diaphragm 22.

Further, high-frequency range sound waves pass through a route RH1 passing through the communication space 42 in the center of the ring member 32 and the front acoustic holes 26, and a route RH2 passing through the rear acoustic hole 8 from an outside of the microphone unit 2, and are transmitted to the diaphragm 22.

Figure 3:
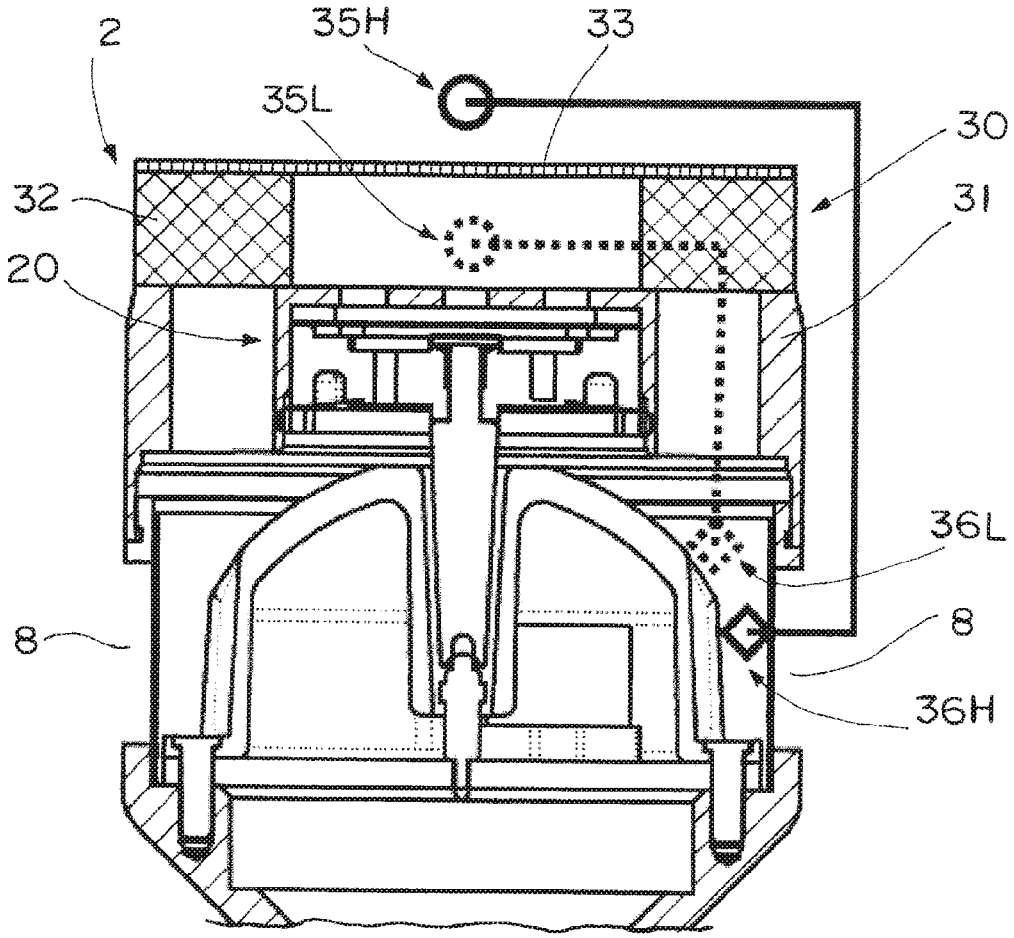
FIG. 3 is a sectional view illustrating positions of acoustic terminals in the microphone unit of FIG. 2.

Further, FIG. 3 is a sectional view illustrating positions of acoustic terminals in the microphone unit 2. As illustrated, a front acoustic terminal 35H in a high-frequency range and a front acoustic terminal 35L in a low-frequency range occur at mutually different positions in a front portion in the microphone unit 2. Further, a rear acoustic terminal 36H in a high-frequency range and a rear acoustic terminal 36L in a low-frequency range occur at mutually different positions in a rear portion in the microphone unit 2.

That is, in the microphone unit 2, a distance between acoustic terminals (the solid line portion in FIG. 3) in the high-frequency range, and a distance between acoustic terminals (the broken line portion in FIG. 3) in the low-frequency range are different.

In other words, the configuration according to the present embodiment enables to change the distance between acoustic terminals according to the frequency, which is conventionally determined to be constant regardless of the frequency of the sound wave.

The distance between acoustic terminals can be shifted in a specific wavelength. Therefore, dips and peaks in frequency characteristics, for example, which are more likely occur in a high-frequency range, can be suppressed by shifting the distance between acoustic terminals in the high-frequency range.

Note that the ring member 32 is provided on the periphery of the front acoustic terminals, and thus a resonance phenomenon occurs at a frequency determined by the volume of the central communication space 42 and a ring opening area. Therefore, by setting parameters such as the height, an inner diameter, a porosity, density of the ring member 32, strength of a resonance and a resonant frequency can be adjusted, and the frequency characteristics can be controlled over a wide range of frequency.

Further, the configuration according to the present embodiment can provide the microphone 1 where howling is hard to occur because a difference of output levels in a front direction and a difference of output levels in a back direction can be made different.

Further, the microphone unit 2 includes the mesh member 33 as the microphone cap 30 to cover the front surface side of the ring member 32. Accordingly, windbreak performance is further improved, and noise generation by wind is further suppressed.

As described above, according to the embodiment of the present invention, the porous ring member 32 is provided in the front portion of the microphone unit 2, so that the routes of the sound waves are divided depending on the frequencies of the sound waves, and the distance between acoustic terminals can be changed.

Accordingly, by shifting the distance between acoustic terminals in a wavelength of a specific sound wave, for example, a microphone unit that suppresses occurrence of the dips and peaks and has stable frequency characteristics can be realized.

Further, the strength of the resonance and the resonant frequency can be adjusted by setting of the height, the inner diameter, the porosity, and the like of the ring member 32. Therefore, the output level can be controlled, and by making the output levels in the front direction and the back direction different, occurrence of the howling can be prevented.

Further, according to the configuration of the present invention, processing such as cutting and drilling for the housing is not necessary while preventing increasing of an external size. Therefore, the manufacturing cost can be reduced.

Note that, in the above embodiment, the description has been given, where the microphone unit 2 is a condenser microphone unit. However, the unidirectional microphone unit according to the present invention is not limited to the embodiment. For example, the above-described embodiment can be applied to a unidirectional dynamic microphone.

The unidirectional microphone according to the present invention will be further described on the basis of an example. In the present example, a microphone including the unidirectional microphone unit described in the above-described embodiment was manufactured and was verified by performing an experiment to measure its frequency characteristics.

In a first example, the applicant of the present application manufactured a unidirectional microphone having the configuration illustrated in FIG. 1.

At this time, parameters such as a height dimension of the ring member, an internal diameter of the central communication space, and a space volume are set to actualize (1) adjusting the distance between acoustic terminals in a high frequency range from 5 kHz to 20 kHz where the dips and peaks are more likely to occur, and (2) making the output levels in the front direction (0°) and the backward direction (180°) to be different.

Figure 4:
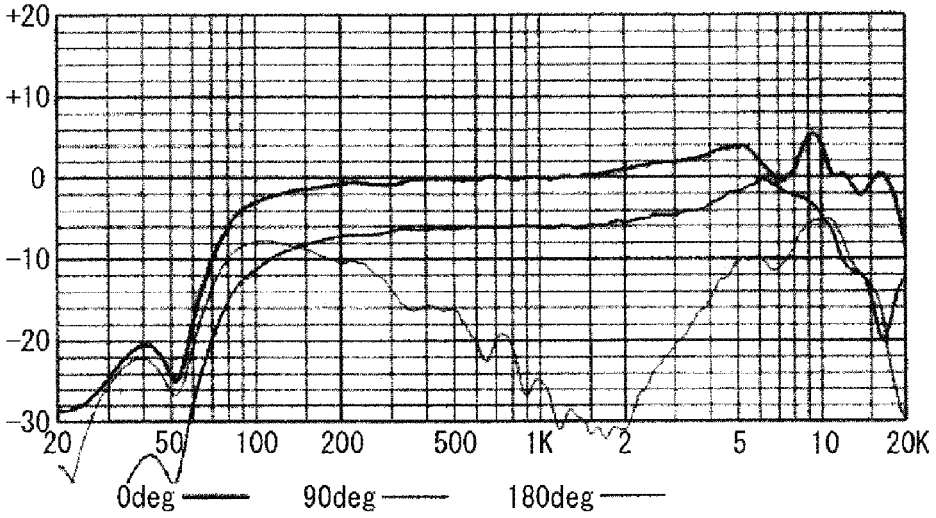
FIG. 4 is a graph of frequency characteristics illustrating a result of a first example.

FIG. 4 is a graph of frequency characteristics measured in the first example. As illustrated in the graph, the unidirectional microphone unit according to the present invention was able to suppress occurrence of large dips and peaks in 5 kHz to 20 kHz.

Further, as illustrated in the graph, the unidirectional microphone unit according to the present invention was able to control the output levels in the front direction (0°) and the backward direction (180°) to become different in a range from 5 kHz to 10 kHz, and was able to prevent occurrence of howling.

Figure 6:
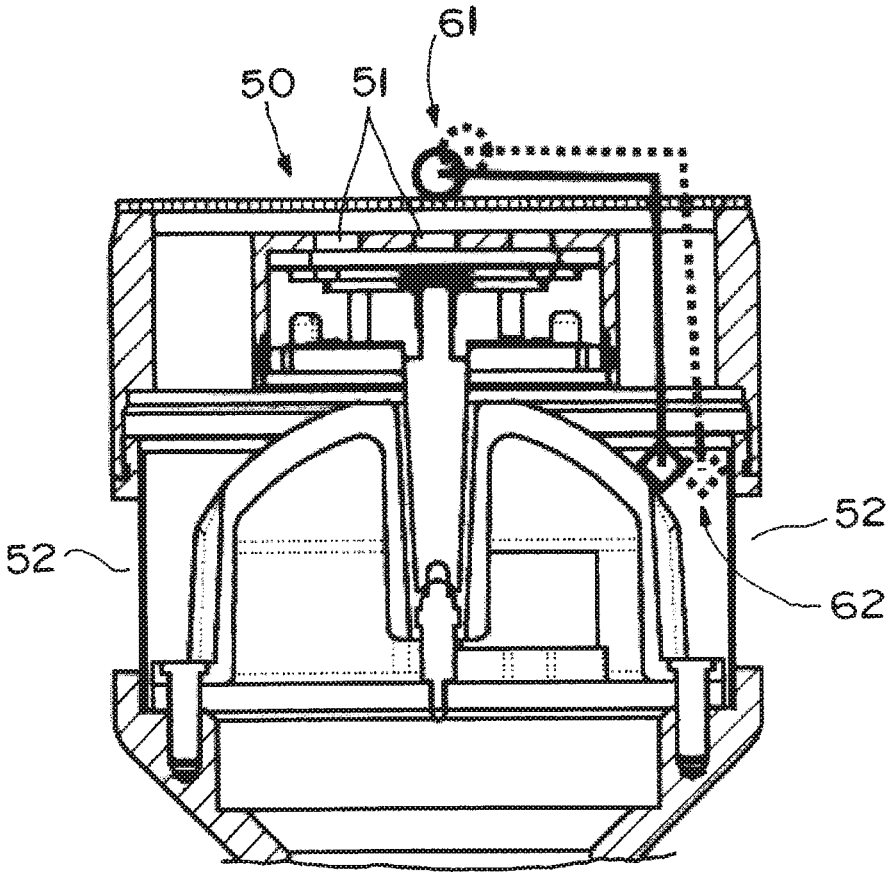
Fig.6 Prior Art
FIG. 6 is a sectional view illustrating a configuration of a conventional microphone unit.
Figure 7A:
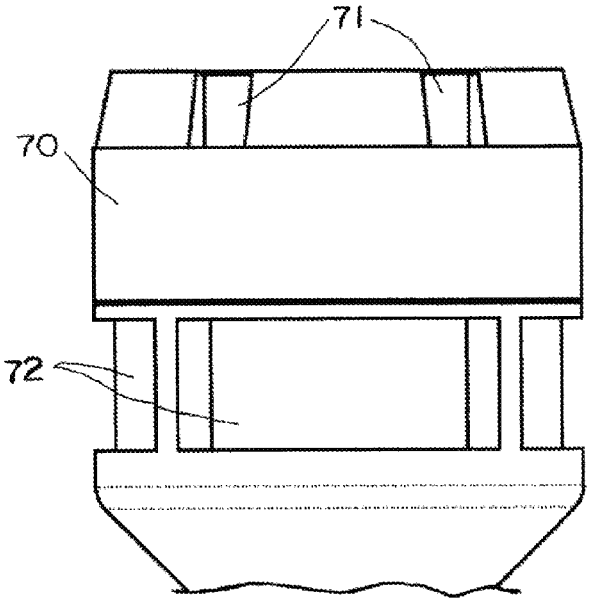
Fig. 7A Prior Art
FIGS. 7A and 7B are a front view and a sectional view for describing counter measures by processing in a conventional microphone unit.
Figure 7B:
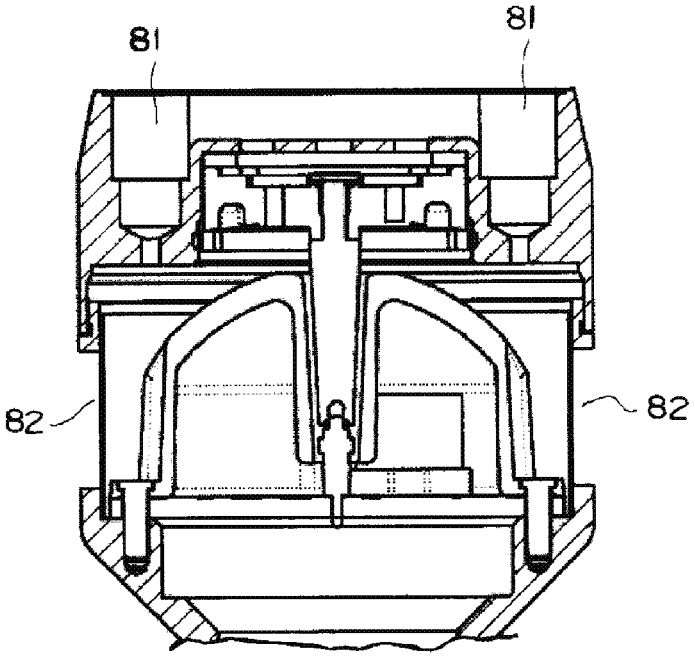
Fig. 7B Prior Art

In a first comparative example, the applicant of the present application used a conventional microphone unit (having a structure not including the porous ring member 32), as illustrated in FIG. 6, and measured its frequency characteristics.

Figure 5:
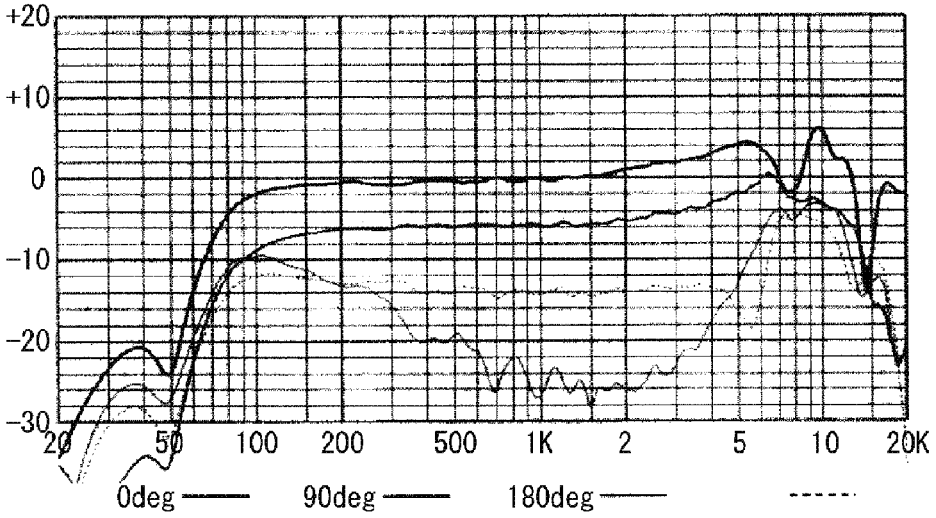
FIG. 5 is a graph of frequency characteristics illustrating a result of a first comparative example.

A graph of the frequency characteristics measured in the first comparative example is illustrated in FIG. 5. As illustrated in the graph, in the conventional microphone unit, large dips and peaks occurred in a range from 5 kHz to 20 kHz.

Further, as illustrated in the graph, in the conventional microphone unit, the output levels in the front direction (0°) and the backward direction (180°) are close in a range from 5 kHz to 10 kHz, and thus the howling occurred.

From the results of the examples, according to the unidirectional microphone unit according to the present invention, it has been confirmed that stable frequency characteristics that can suppress occurrence of the dips and peaks can be obtained.

What is claimed is:

1. A unidirectional microphone unit including a microphone element that converts a sound wave received by a diaphragm into an electrical signal, a front acoustic hole, and a rear acoustic hole, comprising:

a microphone cap covering the microphone element, wherein the microphone cap includes a porous ring member arranged in a front of the microphone element, the porous ring member forming a first communication space communicating with the front acoustic hole in a center side, and a cylindrical member supporting a peripheral edge portion of the ring member and surrounding a periphery side of the microphone element, the cylindrical member forming a second communication space communicating with the rear acoustic hole on the periphery side of the microphone element, whereby the first communication space and the second communication space are communicated through the ring member.

2. The unidirectional microphone unit according to claim 1, further comprising:

a mesh member covering the ring member on a front portion of the ring member.

* * * * *